US010279608B2

(12) United States Patent
Musete et al.

(10) Patent No.: US 10,279,608 B2
(45) Date of Patent: May 7, 2019

(54) METHOD FOR LOADING A WEB; APPARATUS FOR HANDLING A WEB

(71) Applicant: Océ Holding B.V., Venlo (NL)

(72) Inventors: Romeo Musete, New Westminster (CA); Michael Nell, Vancouver (CA); Chad A. Koehn, Venlo (NL); Anne A. Wind, Venlo (NL); Brian D. Otter, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/710,278

(22) Filed: Sep. 20, 2017

(65) Prior Publication Data

US 2018/0088509 A1 Mar. 29, 2018

(30) Foreign Application Priority Data

Sep. 28, 2016 (EP) ..... 16190972

(51) Int. Cl.
*B41J 15/04* (2006.01)
*B65H 23/188* (2006.01)
(Continued)

(52) U.S. Cl.
CPC ..... *B41J 15/042* (2013.01); *B65H 19/105* (2013.01); *B65H 23/1888* (2013.01);
(Continued)

(58) Field of Classification Search
CPC ..... B65H 19/10; B65H 19/30; B65H 20/16; B65H 2301/522; B65H 2301/52; B41J 15/042
See application file for complete search history.

(56) References Cited

U.S. PATENT DOCUMENTS 4,646,986 A 3/1987 Heitmann
4,848,691 A * 7/1989 Muto ..... B65H 19/1831 242/553
(Continued)

FOREIGN PATENT DOCUMENTS

DE 25 34 622 A1 2/1977
WO WO 2016/066617 A1 5/2016

OTHER PUBLICATIONS

European Search Report issued in EP 16 19 0972, dated Apr. 3, 2017.
(Continued)

*Primary Examiner* — Michael C McCullough
(74) *Attorney, Agent, or Firm* — Birch, Stewart, Kolasch & Birch, LLP

(57) ABSTRACT

In wide format web printing the loading of a new web medium is a cumbersome process, requiring the operator to raise a very wide flexible web from the supply roll up to the print surface. The present invention provides a simple apparatus to aid in the manual loading process. The web transport assembly of the apparatus comprises a supply unit arranged for supplying the web from a media roll to a transport path and a pick-up device comprising a pick-up surface and a holding mechanism configured for releasably holding a leading edge section of the web onto the pick-up surface, wherein the pick-up device is moveable between a first position near the supply unit for attaching the leading edge section and a second position near the print surface. The leading edge section is moved upwards towards the print surface while held by the holding mechanism.

20 Claims, 8 Drawing Sheets

(51) Int. Cl.

| | |
|---|---|
| ***B65H 23/24*** | (2006.01) |
| ***B65H 19/10*** | (2006.01) |
| *B41J 11/00* | (2006.01) |
| *B41J 15/16* | (2006.01) |

(52) U.S. Cl.
CPC ..... *B65H 23/245* (2013.01); *B41J 11/0085* (2013.01); *B41J 15/16* (2013.01); *B65H 2301/4493* (2013.01); *B65H 2301/522* (2013.01); *B65H 2403/55* (2013.01); *B65H 2404/143* (2013.01); *B65H 2406/351* (2013.01); *B65H 2406/362* (2013.01); *B65H 2406/363* (2013.01); *B65H 2406/3622* (2013.01); *B65H 2515/314* (2013.01); *B65H 2801/15* (2013.01)

(56) References Cited

U.S. PATENT DOCUMENTS

| | | | | |
|---|---|---|---|---|
| 5,975,457 | A * | 11/1999 | Forbes | B65H 19/102 242/552 |
| 6,228,205 | B1 * | 5/2001 | Rhodes | B65H 19/1852 156/304.3 |
| 6,451,145 | B1 * | 9/2002 | Forbes | B65H 19/1836 156/157 |
| 2016/0221327 | A1 * | 8/2016 | Hanauer | B41F 13/54 |

OTHER PUBLICATIONS

European Search Report, dated Feb. 19, 2018, for European Application No. 17193642.

* cited by examiner

Fig. 1A
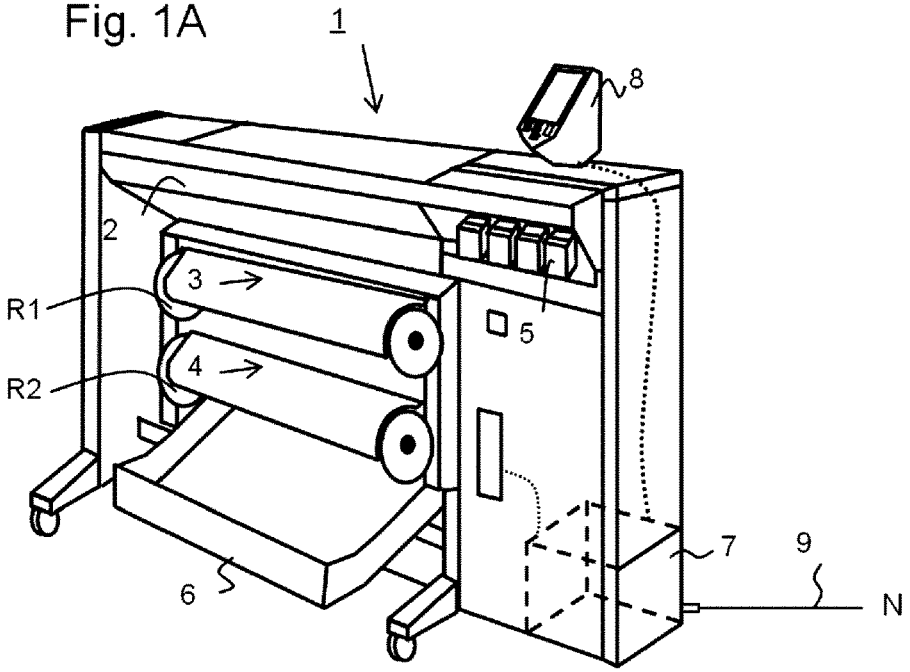
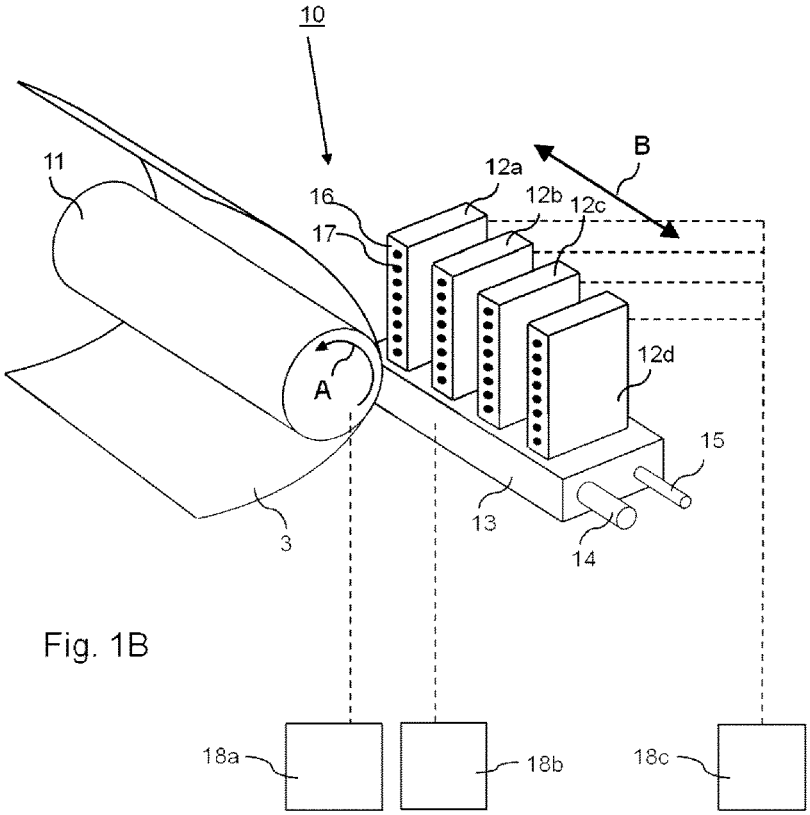
Fig. 1B

METHOD FOR LOADING A WEB; APPARATUS FOR HANDLING A WEB

FIELD OF THE INVENTION

The present invention pertains to a method for loading a web into a transport path of an apparatus. The present invention further pertains to an apparatus for handling a web.

BACKGROUND ART

In a known apparatus a web transport assembly is provided to transport a web along a processing unit. The processing unit is configured for processing the web, such as by forming an image on the web.

The known web transport assembly comprises a transport device, such as a transport nip, which is arranged for moving the web in a transport direction through a transport path along the processing unit. The transport device is arranged downstream of the processing unit relative to the transport direction.

The web transport assembly further comprises a supply unit, such as a driven spindle, arranged for mounting a media roll and for supplying the web from the media roll into the transport path.

During a manual loading of the web from the media roll into the transport path a leading end of the web is unwound from the supply unit. A manual loading of the leading end of the web by an operator into the transport path may become difficult, when the media roll including the web has an increasing width in a transverse direction to the transport path. Especially, in case the transport path extends from the supply unit upwards in a height direction to a processing unit, which is arranged at a height level above the supply unit, said manual loading of the web into the transport path, including loading the web beyond the transport nip, becomes even more difficult.

It is an object of the present invention to provide an apparatus and a method for loading a web into a transport path of an apparatus, wherein the loading can be carried out manually by an operator in an easy way.

SUMMARY OF THE INVENTION

In an aspect, the present invention provides an apparatus for handling a web comprising a processing unit for processing the web and a web transport assembly for transporting the web through a transport path along the processing unit, the web transport assembly comprising:

- a supply unit arranged for mounting a media roll and for supplying the web from the media roll to the transport path;
- a pick-up device comprising a pick-up surface and a holding mechanism configured for releasably holding a leading edge section of the web onto the pick-up surface, wherein the pick-up device is moveable between a first position near the supply unit for attaching the leading edge section to the pick-up device and a second position positioned at an upstream end of a web supporting surface below the processing unit.

For loading a new web medium, the operator attaches the leading edge section of the web to the pick-up surface of the pick-up device in the first position. The first position positions the pick-up surface approximate the web supply unit. From the web supply unit a leading edge section of the web is unwound. The holding mechanism preferably holds the leading edge section over its full width. The pick-up surface which is preferably provided on a page-wide rigid support plate supports the leading edge section in a moveable manner. The pick-up surface is then moved upwards to the second position.

The leading edge section is then moved in holding engagement with the pick-up surface. At the second position, the leading edge section is positioned adjacent a further medium support surface below the print unit (print surface for short). The holding mechanism then releases the leading edge section, which is then transferred to the further medium support surface, preferably in a substantially horizontal motion. The present invention is especially advantageous in wide format web printing wherein media widths may exceed 3 meters. The operator then needs to lift the very wide and flexible leading edge section from the supply roll up to the print station. In the present invention the leading edge section is attached to the pick-up surface and moved upwards to the print station by movement of the pick-up surface. The operator thus need only move the pick-up surface, which is less cumbersome then raising the unsupported leading edge section to the height of the print station. Thereby, easy manual loading of the web medium by a simple device is achieved.

In a preferred embodiment, the pick-up surface is provided at an end of a lever, said lever being pivotable around a shaft preferably extending in the lateral direction of the transport path. A page wide support plate is mounted at the end of the lever, said support plate defining the pickup surface. The lever is pivotable around a pivot axis between the first and second position. Preferably, the lever is pivotable around a shaft extending in the lateral direction of the transport path. The first position when in use is positioned below the second position near the supply unit. The second position is positioned above the supply unit, preferably at a height level similar to the print surface below the print station. By pivoting the lever in a first direction, the pick-surface is moved upwards, bringing the leading edge section to the height level of the print station.

In another embodiment, the lever when in use is positioned above the transport path. Preferably, the pivot axis of the lever is positioned above or over the supply unit. The lever may in an example be attached to a media cover configured to be positioned over the transport path for shielding the web medium during use. In a preferred embodiment, the lever is a media cover forming said media cover, such that in the first position the media cover plate shields part of the transport path. The media cover plate in the first position preferably hangs vertically. In the second position the media cover plate is preferably substantially horizontal and above the transport path. This allows the operator to easily access the holding device for releasing the leading edge section. Prior to printing the media cover plate is returned to the first position where it shields part of the web medium. The media cover plate has the double function of facilitating easy media loading and shielding the web medium during operation. The shielding function is particularly advantageous if the printer comprises a curing light source for curing ink. Such a light source is for example an UV light source, which source during curing is shielded by the media cover plate. This prevents harmful radiation from reaching the operator.

In another embodiment, the lever is provided with urging elements for urging the pick-up device from the first to the second position. The urging elements are mounted to the lever and comprise force means, such as a spring or a gas strut. The urging elements allow the operator to move the pick-up device with web medium attached to it with relatively little effort.

In a further embodiment, the holding mechanism comprises a clamp for clamping the leading edge section. The clamp comprises a securing means such as a spring to keep the leading edge section clamped against the pick-up surface. Such a clamp is simple and cheap to implement and easy to operate.

In another embodiment, the processing station comprises a support plate and the pick-up device is positioned upstream of the support plate. The support plate supports the web medium during processing, specifically printing. During use the support plate extends horizontally below the print heads of the print station. The support plate or print surface is position higher than the supply unit. The transport path in practice often comprises a substantially vertical section between the supply unit and the print surface wherein the web medium is unsupported. No transport pinches or other support plate are generally present along this free vertical section of the transport path. This lacks of support makes manual loading of a wide format web particularly difficult. The present invention solves this loading issue by attaching the web to the pick-up surface. The pick-up surface then traverses the free vertical section to bring the leading edge section to the print surface.

In another aspect of the present invention apparatus is provided for handling a web comprising a processing unit for processing the web and a web transport assembly for transporting the web through a transport path along the processing unit, the web transport assembly comprising:

- a supply unit arranged for mounting a media roll and for supplying the web from the media roll to the transport path;
- a pick-up device comprising a pick-up surface arranged facing the transport path and an attraction mechanism configured for attracting a contact side of the web onto the pick-up surface; and
- a control unit configured for, during media loading, controlling the attraction mechanism to hold the leading end of the web onto the pick-up surface.

The control unit controls the attraction mechanism. The control unit may activate the attraction mechanism to hold the leading end of the web onto the pick-up surface during media loading. The pick-up device comprises the pick-up surface and the attraction mechanism to hold the web onto the pick-up surface. The apparatus is configured to support the loading method according to the present invention.

In an embodiment, the attraction mechanism comprises a suction source for providing a suction pressure and a plurality of suction holes distributed over the pick-up surface and operatively connected to the suction source for providing the suction pressure to the contact side of the web to hold the leading end of the web. Said attraction mechanism supports an easy and accurate control over the holding action of the web by adjusting the suction pressure through the plurality of suction holes to hold the contact side of the web. The suction pressure may suitably be adjusted to hold the contact side of the web fixed onto the pick-up surface. Said plurality of suction holes may comprise at least one row of suction holes arranged across the transport path and may comprise a plurality of rows of suction holes arranged across the transport path. Said plurality of suction holes may comprise a plurality of segments, wherein the suction pressure of each segment is controllable by the attraction mechanism independently one another.

Said suction source may comprise a fan, may comprise an external vacuum pressure source and may be any other source for providing a suction pressure at the suction holes.

In an embodiment, the pick-up surface is arranged at a height level being substantially equal to a height level of the processing unit relative to a height direction. In this way, a manual loading of the leading end of the web into the transport path beyond the processing unit is facilitated as the pick-up surface is arranged at the same height level as the height level of the processing unit, i.e. relative to the gravity direction. The pick-up surface including the attraction mechanism are arranged to hold the leading end of the web after raising the leading end of the web to the height level of the processing unit at the pick-up surface. Any further threading step of the leading end of the web from the pick-up surface through the transport path beyond the processing unit may be easily performed by the operator.

In an embodiment, the pick-up surface has a curved shape for bending the web along the transport path towards the processing unit. In example, the pick-up surface is provided by a turn bar for turning a web, such as a web coming from below a processing unit towards a part of the transport path along the processing unit, such as a transport path arranged along a support plate of the processing unit.

In an embodiment, the web transport assembly further comprises a foot pedal operable by the operator and operatively connected to the control unit for activating the supply unit to unwind the web from the media roll. The foot pedal supports the control on the supply unit to unwind the web from the media roll. In this way, the hands of the operator are free to manual load the leading end of the web onto the pick-up surface and/or manual thread the leading end of the web further through the transport path beyond the processing unit.

In an embodiment, the control unit is configured for deactivating the attraction mechanism to release the leading end of the web from the pick-up surface in response to an operator input. The operator may provide an operator input to the control unit in order to release the leading end of the web from the pick-up surface, e.g. when the operator has moved to another position for further loading the leading end of the web through the transport path. In this way, threading of the leading end of the web beyond the processing unit is facilitated, as the attraction mechanism releases the leading end of the web, thereby allowing the leading end of the web to move along the transport path.

In an embodiment, the web transport assembly further comprises a transport device arranged for moving the web through the transport path, and wherein the control unit is configured to activate the transport device to drive the web after releasing the leading end of the web from the pick-up surface. In this way, the web is only driven by the transport device after the web is released from the pick-up surface. In case the web is held at the pick-up surface by the attraction mechanism, a movement of the web along the transport path is obstructed.

In an embodiment, the pick-up device is a friction-based tensioning device, which is arranged, during a further processing of the web after the media loading, for tensioning the web between the friction-based tensioning device comprising a guiding surface, which is the pick-up surface according to the present invention, and the transport device.

In an embodiment, the transport device is arranged for moving the web in a transport direction through a transport path along the processing unit, the transport device being arranged downstream of the processing unit relative to the transport direction; and the friction-based tensioning device is arranged upstream of the processing unit relative to the transport direction; wherein the friction-based tensioning device comprises a guiding surface for guiding the web towards the processing unit and a plurality of suction holes distributed over the guiding surface for providing a suction force to a contact side of the web, the plurality of suction holes being arranged in fluid communication to a suction source, which generates the suction force, wherein the guiding surface is configured to exert a friction force on the web in response to the suction force provided to the contact side of the web; and wherein the friction-based tensioning device is configured for controlling a tension of the web between the guiding surface and the transport device.

The friction-based tensioning device provides a suction force, or suction pressure, via the suction holes to the contact side of the web. As a result the web is controllably held in contact with the guiding surface of the friction-based tensioning device. The guiding surface is configured to exert a friction force on the contact side of the web in response to the suction force provided to the contact side of the web. The friction-based tensioning device is configured for controlling a tension of the web between the guiding surface and the transport device based on the friction force provided.

In an example, the transport device transports the web in the transport direction through the transport path along the processing unit, while the web slides along the guiding surface in response to the friction force provided. As such, the friction force at the guiding surface determines the tension of the web between the guiding surface and the transport device.

In another example, the friction-based tensioning device comprises a rotatable roller comprising the guiding surface at its circumference; and the friction-based tensioning device further comprises a friction mechanism, such as a journal bearing assembly or a plain bearing assembly, coupled to the rotatable roller and configured for controlling a friction force for restraining a rotation of the roller around its rotation axis. The friction force provided by the friction mechanism to the rotatable roller controllably restrains the rotation of the roller around its rotation axis. The guiding surface of the roller is in rolling contact to the contact side of the web while controlling the tension of the web by the friction mechanism restricting a rotation of the roller. As a result, said friction force generated by the friction mechanism determines the tension of the web along the transport path between the guiding surface and the transport device. In this example, the friction force acting on the contact side of the web via the guiding surface is selected higher than the friction force acting on the roller, which restrains the rotation of the roller, in order to prevent a sliding movement of the web over the guiding surface.

The guiding surface of the friction-based tensioning device may be the pick-up surface according to the present invention, wherein the attraction mechanism comprises the plurality of suction holes distributed over the guiding surface for providing a suction force to a contact side of the web, the plurality of suction holes being arranged in fluid communication to a suction source, which generates the suction force.

During the media loading, the suction force or suction pressure at the plurality of suction holes may be increased to hold the leading end of the web fixed. Furthermore, during a further processing of the web after the media loading, the suction force may be suitably adjusted, e.g. reduced, to provide a sliding contact between the guiding surface and the contact side of the web in order to control a tension of the web.

The friction-based tensioning device may comprise an array of suction holes arranged across the transport path. In this way, the suction force is easily provided to the web at the guiding surface along a transverse direction arranged across to the transport path.

In an embodiment, the web transport assembly further comprises a control unit operatively coupled to the suction source to control the friction force provided to the contact side of the web. The control unit controls the suction force, such as a negative air pressure, provided by the suction source to the contact side of the web via the plurality of suction holes. The control unit is configured to adjust the friction force provided by the guiding surface to the web by adjusting the suction force. The control unit may be operatively coupled to a suction pump as suction source to control the suction force. Alternatively or additionally, the suction source may comprise a valve for controlling the suction force communicated to the suction holes and the control unit is operatively coupled to the valve to control the suction force.

In an example, the control unit may be configured to adjust the suction force in response to a media type selected for the web and based on a media catalogue comprising a set of media types, each media type being associated to a suction force level, such as a negative air pressure level, for controlling the friction force. In this way, the friction force is easily controlled independent of the media type used as a web. A media type of the web may affect the friction force generated by the guiding surface in response to the suction force, such as by a surface property of the contact side of the web and/or a suction permeability of the web.

In another example, the control unit may be configured to adjust the friction force based on a movement of the web by the transport device along the transport device. In particular, a sensor may be provided along the transport path to determine a movement of the web by the transport device along the transport path. The sensor is connected to the control unit to provide a signal to the control unit indicating the movement of the web along the transport path. The control unit may adjust the friction force provided to the contact side of the web to control the tension of the web such that a measured movement of the web provided by the transport device is substantially equal to a desired movement of the web.

In an embodiment, the web transport assembly further comprises a support plate for supporting the web at the processing unit, the support plate being configured for attracting the web to the support plate. The processing unit may comprise a processing head, such as a print head, arranged for facing the support plate. The support plate supports processing of the web by the processing unit by attracting the web to the support plate, thereby arranging the web at a predetermined processing position.

In an example, the support plate may comprise a plurality of suction holes distributed over the support plate for communicating a suction force to the web to attract the web to the support plate. In an alternative example, the support plate may be configured to attract the web to the support plate by an electrostatic force.

In an embodiment, the control unit is configured to control the suction force at the guiding surface, such that a friction force provided to the web by the guiding surface is substantially higher than a friction force provided to the web by the support plate. In this way, the friction-based tensioning device accurately controls the tension of the web along the transport path between the guiding surface and the transport device. As the friction force of the guiding surface is controlled to be higher than a friction force provided to the web by the support plate, the tension of the web along the transport path is accurately controlled. As such, a movement of the web along the transport path is accurately controlled by the transport device independently of the attraction of the web to the support plate as the tension of the web along the transport path is accurately controlled by the friction-based tensioning device.

In an embodiment, the control unit is configured to control the attraction of the web to the support plate; and wherein the control unit is configured to adjust the attraction of the web to the support plate depending on a movement of the web by the transport device along the support plate. In an example, the control unit may reduce an attraction force to the support plate, when the web is moved along the support plate, and/or may increase the attraction force to the support plate, when the web is held stationary with respect to the support plate. In this way, tension control of the web by the friction-based tensioning device is further improved. The friction force provided by the friction-based tensioning device to the web supports reliable and accurate positioning of the web at the processing unit, when the web is transported by the transport device in the transport direction.

In an embodiment, the plurality of suction holes comprises separate segments partitioned along a transverse direction arranged across to the transport path, and wherein a suction force provided to the web at each of the segments is controllable independently of one another. As the suction force is controllable for each of the segments independently of one another, the friction force to the web is controllable at each of the segments along the transverse direction independently of one another. As a result, the tension of the web in the transport direction can be adjusted for each segment along the transverse direction independently of one another. In this way, any tension variations of the web along the transverse direction can be minimized.

In an example of the embodiment, the web may be steered by the friction-based tensioning device with respect to the transport path, such as skewed by providing a gradient in a tension of the web along the transverse direction.

In yet another example of the embodiment, a first segment of suction holes is arranged for tensioning a first web and a second segment of suction holes is arranged for tensioning a second web, which is arranged alongside of the first web. The friction-based tensioning device of this embodiment supports a tandem processing of a first web and a second web alongside of one another while controlling a tension of each web independently of one another.

In an embodiment, the guiding surface is substantially stationary arranged with respect to the transport path and wherein the tension of the web is controlled by a sliding movement of the web along the guiding surface in response to the friction force provided to the contact side of the web at the guiding surface. The guiding surface is stationary arranged with respect to the transport path and the web makes a sliding movement along the guiding surface, when the web is moved in the transport direction by the transport device, in response to the friction force provided by the guiding surface. In this way, the tension of the web in the transport direction is controlled by the friction force provided to the contact side of the web at the guiding surface.

In an embodiment, the friction-based tensioning device comprises a rotatable roller comprising the guiding surface at its circumference; and wherein the friction-based tensioning device further comprises a friction mechanism coupled to the rotatable roller and configured for controlling a friction force for restraining a rotation of the roller around its rotation axis. The friction force provided to the rotatable roller by the friction mechanism, such as a journal bearing assembly or a plain bearing assembly, restrains the rotation of the roller around its rotation axis. The guiding surface of the roller is in rolling contact to the contact side of the web while controlling the tension of the web by the friction force acting on the roller. In examples, the friction mechanism, such as a journal bearing assembly or a plain bearing assembly, may be coupled to a shaft of the roller and may be coupled to a portion of the outer circumference of the roller.

As a result, said friction mechanism, which restraining a rotation of the roller around its rotation axis, controls the tension of the web between the friction-based tensioning device and the transport device. In this embodiment, the friction force acting on the contact side of the web via the guiding surface is selected higher than the friction force acting on the roller, which restrains the rotation of the roller. As such, the web pulls the roller, thereby driving a rotation of the roller around its rotating axis, while the web is moved in the transport direction along the transport path by the transport device. During media loading, the rotatable roller, which is rotatably arranged in tensioning operation of the web, is retained stationary with respect to its rotation axis to hold the contact side of the web stationary relative to the transport path.

In an embodiment, the friction-based tensioning device comprises a rotatable lever assembly comprising a shaft coinciding with a rotation axis of the lever assembly, a guiding plate comprising the guiding surface, a lever element arranged for connecting the guiding plate to the shaft and a spring mechanism coupled to the lever assembly and configured for controlling a torque force for restraining a rotation of the guiding plate around the rotation axis. The spring mechanism controls a torque force acting on the lever assembly, which torque force is directed to restrain a rotation of the guiding plate around rotation axis. The torque force provided by the spring mechanism depends on a rotation angle of the lever element, including the guiding plate, about the rotation axis of the lever assembly. The web is attracted to the guiding surface of the guiding plate by a suction force provided to the contact side of the web.

In case the web is moved in the transport direction by the transport device, the guiding plate is moved by the web in an arched way along the transport path by rotation about the rotation axis. As a result, the torque force provided by the spring mechanism to the lever assembly increases, thereby increasing the tension of the web in the transport direction. At the point the tension of the web reaches to a level equal to the friction force provided at the guiding surface, the web starts to slide along the guiding surface. As a consequence, the tension of the web is controlled to be substantially constant, while the guiding plate is held substantially stationary with respect to the transport path, i.e. at a constant rotation angle about the rotations axis, by the spring mechanism.

The tension of the web can be easily adjusted by adjusting the suction force provided to the web at the guiding surface. When adjusting the suction force to adjust the friction force, the rotatable lever assembly will obtain another rotation angle about the rotation axis, which rotation angle corresponds to the torque force of the spring mechanism being substantially equal to the friction force provided at the guiding surface.

As such, a rotation angle of the lever element provides a measure of the torque force of the spring mechanism and, consequently, of a tension of the web in the transport direction.

In an embodiment, the rotatable roller comprises separate roller segments partitioned along a transverse direction arranged across to the transport path, and wherein the friction mechanism is arranged to control a friction force provided to each of the roller segments independently of one another. Each of the roller segments has a guiding surface for contacting the contact side of the web, wherein a suction force is provided to control a friction of the roller segment to the contact side of the web. The friction mechanism controls a friction force provided to each of the roller segments independently of one another. In an example, the friction mechanism comprises a plurality of bearing elements, each bearing element being arranged in contact to one of the roller segments for controlling the friction force. As such, each segment of the roller is rotatable independently of one another.

In this way, the tension of the web in the transport direction may be varied along the transverse direction by the friction mechanism, i.e. by controlling each of the roller segments.

In an embodiment, the rotatable lever assembly comprises separate lever segments partitioned along a transverse direction arranged across to the transport path, and wherein the spring mechanism is arranged to control a torque force provided to each of the lever segments independently of one another. Each of the lever segments comprises a lever element and a guiding plate having a guiding surface for contacting the contact side of the web, wherein a suction force is provided to control a friction of the guiding plate to the contact side of the web. The spring mechanism controls a torque force provided to each of the lever segments independently of one another. In an example, the spring mechanism comprises a plurality of spring elements, each spring element being connected to one of the guide plates for controlling the torque force provided to the guide plate, respectively. As such, each segment of the lever assembly is rotatable around the rotation axis independently of one another.

In this way, the tension of the web in the transport direction may be varied along the transverse direction by the spring mechanism, i.e. by controlling each of the lever segments independently one another.

In an embodiment, the friction-based tensioning device comprises a rotation angle measuring device arranged for measuring a rotation angle of the lever element about the rotation axis of the lever assembly to determine the tension of the web. The rotation angle measuring device may comprise a rotation scale for indicating a rotation angle of the lever element about the rotation axis. The rotation scale may be configured to be readable by an operator. The rotation angle of the lever element about the rotation axis is a measure of the tension of the web in the transport direction.

In an example, the friction-based tensioning device comprises a lever assembly comprising a first lever segment and a second lever segment arranged adjacent one another; and a first rotation angle measuring device arranged for measuring a rotation angle of the first lever segment and a second rotation angle measuring device arranged for measuring a rotation angle of the second lever segment. In this way, a tension of a first side, e.g. left hand side, of the web may be measured by use of the first rotation angle measuring device and a tension of a second side, e.g. right hand side, of the web may be measured by use of the second rotation angle measuring device.

In an embodiment, the guiding surface has a curved shape for bending the web along the transport path towards the processing unit. In example, the guiding surface is provided by a turn bar for turning a web, such as a web coming from below a processing unit towards a path along the processing unit, such as a transport path arranged along a support plate of the processing unit. The guiding surface, such as provided by the turn bar, may be arranged substantially at a same height level with respect to a gravity direction as the height level of the support plate of the processing unit.

In this way, the guiding surface may also be used for holding the web at substantially the same height level with respect to a gravity direction as the support plate of the processing unit. Furthermore, the guiding surface may be used as a pick-up surface for holding parts of the web by providing a suction force at the guiding surface, while manually loading the web from a roll into the transport path by unrolling the web from the roll. This arrangement supports easy manually loading of the web into the transport path even when the web has a large width in a transverse direction across the transport path.

In examples, the turn bar may be arranged stationary with respect to the transport path and the turn bar may be rotatably arranged around a rotation axis arranged across the transport path, wherein the turn bar has the guiding surface arranged at its circumference. During media loading, the turn bar, which is rotatably arranged in normal operation, is retained stationary with respect to the rotation axis to hold the contact side of the web stationary relative to the transport path.

In an embodiment, the transport device is configured for moving the web intermittently along the processing unit. The embodiment supports processing of the web, while the web is held stationary with respect to the transport path. The friction-based tensioning device enables accurate tension control of the web, wherein the transport device moves the web intermittently in the transport direction along the processing unit. In an example, the friction-based tensioning device may be configured to adjust the friction force provided by the guiding surface to the web dependent on the movement of the web. The friction force may be easily and quickly adjusted by the friction-based tensioning device by changing the suction force provided at the guiding surface.

In another aspect of the present invention a printer apparatus is provided comprising the web transport assembly according to the present invention, wherein the processing unit comprises a print head assembly configured for forming an image on the web.

The print head assembly may be mounted on a carriage for a scan wise movement over the web across the transport path. The printer apparatus facilitates manual loading of the web during the media loading procedure and provides improved control on the tension of the web during transport of the web along the print head assembly, after media loading, while reducing complexity of the web transport assembly. For example, no additional dancer assembly is required to accurately control the tension of the web along the transport path at the processing unit.

In another aspect of the present invention, a method is provided for loading a web into a transport path of an apparatus, the apparatus comprising a processing unit for processing the web and a web transport assembly being configured for transporting the web from a supply unit through the transport path along the processing unit, the web transport assembly comprising a pick-up surface arranged facing the transport path and an attraction mechanism configured for attracting a contact side of the web onto the pick-up surface; the method comprising the steps of: a) mounting a media roll into the supply unit; and b) manually loading by an operator a first part of the leading end of the web onto the pick-up surface, the attraction mechanism holding the first part of the leading end of the web on the pick-up surface by attracting the contact side of the web.

The method solves the problem by holding the leading end of the web, i.e. the first part of the leading end, on the pick-up surface by attracting the contact side of the web. The pick-up surface is arranged facing the transport path. An attraction mechanism is provided, which is configured for holding the contact side of the web onto the pick-up surface. In embodiments, the attraction mechanism may be activated by the operator and the attraction mechanism may be automatically activated during media loading in response to a presence of the web at the pick-up surface. The operator may manually load the first part of the leading end of the web onto the pick-up surface, wherein the attraction mechanism holds the web onto the pick-up surface. In this way, the operator is free to leave the first part of the leading end of the web held onto the pick-up surface, while moving to another position to continue the manual loading operation.

In an example, the operator may move around the apparatus after the loading step b) to take the leading end of the web from the pick-up surface for a further manual loading of the web along the transport path, such as beyond the processing unit and/or beyond a transport nip.

In another example, alternatively or additionally, the operator may move sideways after the loading step b) to manually load a second part of the leading end of the web onto the pick-up surface. In this way a web having relatively large width may be manually loaded in an easy way into the transport path in several steps.

The pick-up surface, including the attraction mechanism, may extend over a part of the width of the transport path, i.e. across the transport path, and may extend completely across the transport path.

As defined herein holding the first part of the leading end of the web on the pick-up surface is keeping the first part of the leading end of the web fixed onto the pick-up surface. As such, the first part of the leading end of the web cannot move along the transport path during the holding action of the attraction mechanism.

In an embodiment, step b) comprises the operator activating the supply unit to unwind the leading end of the web from the media roll. In this way, the manual loading of the first part of the leading end of the web is supported, as the operator does not have to unwind the leading end of the web manually.

In an embodiment, the attraction mechanism comprises a plurality of suction holes distributed over the pick-up surface and the holding step of step b) comprises providing a suction pressure through the plurality of suction holes to a contact side of the web. Said attraction mechanism is easily controlled by adjusting the suction pressure through the plurality of suction holes to hold the contact side of the web. In case the suction pressure is not sufficient to keep the web fixed onto the pick-up surface, the suction pressure may be suitably increased. Furthermore, in case the leading end of the web is to be moved further along the transport path, the leading end of the web may be released from the pick-up surface by reducing or removing the suction pressure provided at the pick-up surface.

In an alternative embodiment, the attraction mechanism may provide an electrostatic force from the pick-up surface to the contact side of the web to hold the contact side of the web. Alternatively, the attraction mechanism may be any other mechanism for holding the contact side of the web by attracting the contact side of the web. In any of these examples of the attraction mechanisms, the attraction mechanism may be controlled by a control unit of the apparatus.

In an embodiment, the method further comprises the step of: c) manually loading by an operator a second part of the leading end of the web onto the pick-up surface, the attraction mechanism holding the second part of the leading end of the web on the pick-up surface by attracting the contact side of the web. Said second part of the leading end of the web may be a side portion of the leading end of the web and may be any other portion of the leading end of the web. By performing the steps b) and c) subsequently, the operator may freely move sideways across the transport path between these steps to manually load a first part and a second part of the leading end of the web, successively, onto the pick-up surface. In this way, loading of the leading end of the web in several manual steps across the transport path is facilitated.

In an embodiment, step b) comprises allowing the second part of the leading end of the web to fold away from the pick-up surface before step c). In this way, an easy loading of the first part of the leading end of the web and the second part of the leading end of the web onto the pick-up surface is facilitated. As the second part of the leading end of the web is allowed to fold away from the pick-up surface, the transport path is easily accessible during a sub sequent step c) for loading the second part of the leading end of the web onto the pick-up surface.

In an embodiment, step c) comprises sliding over an outer side of the web along the pick-up surface starting from the first part of the leading end of the web to unfold the second part of the leading end of the web onto the pick-up surface. This supports a fast and simple manual positioning of the second part of the leading end of the web by the operator onto the pick-up surface.

In an embodiment, the method further comprises the step of: d) threading by an operator the leading end of the web from the pick-up surface through the transport path and beyond the processing unit. The threading step may be performed by the operator after the operator has moved to another position for accessing the transport path beyond the pick-up surface. The holding action of the attraction mechanism of step b), and optionally including step c), at the pick-up surface support the threading step of the operator. In this way, the operator may easily and manually load the leading end of the web through the transport path and beyond the processing unit, even in case the transport path extends further than an arm's length.

In an embodiment, step d) comprises deactivating the attraction mechanism to release the leading end of the web from the pick-up surface. In this way, the threading of the leading end of the web through the transport path beyond the pick-up surface is supported. In an example, the operator may deactivate the attraction mechanism, such as by providing an operator input to a control unit for controlling the attraction mechanism. Alternatively, the attraction mechanism may be deactivated automatically by a control unit, such as in response to a predetermined holding time.

In an embodiment, wherein step d) comprises the operator activating the supply unit to unwind the web from the media roll. In this way, the threading step of the leading end of the web further along the transport path is supported by the supply of the web from the media roll into the transport path. The operator may activate the supply unit by operating a switch, such as a foot pedal, operatively connected to a control unit for controlling the supply unit to unwind the web from the media roll.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein:

FIG. 1A shows an image forming apparatus, wherein printing is achieved using a wide format inkjet printer.

FIG. 1B shows an ink jet printing assembly.

DETAILED DESCRIPTION OF THE DRAWINGS

Figure 2A:
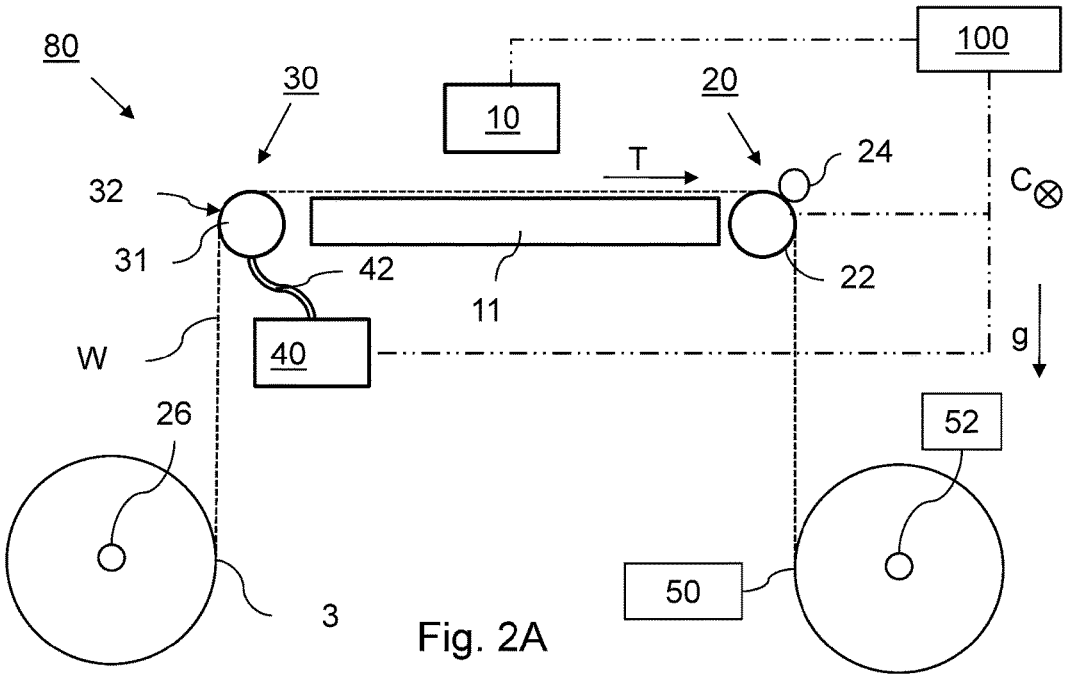
FIGS. 2A-2E show schematically an embodiment of a web transport assembly for transporting a web along a processing unit and a method for loading the web according to the present invention.

The present invention will now be described with reference to the accompanying drawings, wherein the same reference numerals have been used to identify the same or similar elements throughout the several views. FIG. 1A shows an image forming apparatus 1, wherein printing is achieved using a wide format inkjet printer. The wide-format image forming apparatus 1 comprises a housing 2, wherein the printing assembly, for example the ink jet printing assembly shown in FIG. 1B is placed. The image forming apparatus 1 also comprises a storage means for storing image receiving member 3, 4, a delivery station to collect the image receiving member 3, 4 after printing and storage means 5 for marking material. In FIG. 1A, the delivery station is embodied as a delivery tray 6. Optionally, the delivery station may comprise processing means for processing the image receiving member 3, 4 after printing, e.g. a folder or a puncher. The wide-format image forming apparatus 1 furthermore comprises means for receiving print jobs and optionally means for manipulating print jobs. These means may include a user interface unit 8 and/or a control unit 7, for example a computer.

Images are printed on an image receiving member, for example paper, supplied by a roll 3, 4. The roll 3 is supported on the roll support R1, while the roll 4 is supported on the roll support R2. Alternatively, cut sheet image receiving members may be used instead of rolls 3, 4 of image receiving member. Printed sheets of the image receiving member, cut off from the roll 3, 4, are deposited in the delivery tray 6.

Each one of the marking materials for use in the printing assembly are stored in four containers 5 arranged in fluid connection with the respective print heads for supplying marking material to said print heads.

The local user interface unit 8 is integrated to the print engine and may comprise a display unit and a control panel. Alternatively, the control panel may be integrated in the display unit, for example in the form of a touch-screen control panel. The local user interface unit 8 is connected to a control unit 7 placed inside the printing apparatus 1. The control unit 7, for example a computer, comprises a processor adapted to issue commands to the print engine, for example for controlling the print process. The image forming apparatus 1 may optionally be connected to a network N. The connection to the network N is diagrammatically shown in the form of a cable 9, but nevertheless, the connection could be wireless. The image forming apparatus 1 may receive printing jobs via the network. Further, optionally, the controller of the printer may be provided with a USB port, so printing jobs may be sent to the printer via this USB port.

FIG. 1B shows an ink jet printing assembly 10. The ink jet printing assembly 10 comprises supporting means for supporting an image receiving member 3. The supporting means 11 are shown in FIG. 1B as a platen 11, but alternatively, the supporting means 11 may be a flat surface. The platen 11, as depicted in FIG. 1B, is a rotatable drum 11, which is rotatable about its axis as indicated by arrow A. The supporting means 11 may be optionally provided with suction holes for holding the image receiving member 3 in a fixed position with respect to the supporting means 11. The inkjet printing assembly 10 comprises print heads 12*a*-12*d*, mounted on a scanning print carriage 13. The scanning print carriage 13 is guided by suitable guiding means 14, 15 to move in reciprocation in the main scanning direction B. Each print head 12*a*-12*d* comprises an orifice surface 16, which orifice surface 16 is provided with at least one orifice 17. The print heads 12*a*-12*d* are configured to eject droplets of marking material onto the image receiving member 3. The platen 11, the carriage 13 and the print heads 12*a*-12*d* are controlled by suitable controlling means 18*a*, 18*b* and 18*c*, respectively.

The image receiving member 3 may be a medium in web or in sheet form and may be composed of e.g. paper, cardboard, label stock, coated paper, plastic, canvas, film or textile. Alternatively, the image receiving member 3 may also be an intermediate member, endless or not. Examples of endless members, which may be moved cyclically, are a belt or a drum. The image receiving member 3 is moved in the sub-scanning direction A by the platen 11 along four print heads 12*a*-12*d* provided with a fluid marking material. A scanning print carriage 13 carries the four print heads 12*a*-12*d* and may be moved in reciprocation in the main scanning direction B parallel to the platen 11, such as to enable scanning of the image receiving member 3 in the main scanning direction B. Only four print heads 12*a*-12*d* are depicted for demonstrating the invention. In practice an arbitrary number of print heads may be employed. In any case, at least one print head 12*a*-12*d* per color of marking material is placed on the scanning print carriage 13. For example, for a black-and-white printer, at least one print head 12*a*-12*d*, usually containing black marking material is present. Alternatively, a black-and-white printer may comprise a white marking material, which is to be applied on a black image-receiving member 3. For a full-color printer, containing multiple colors, at least one print head 12*a*-12*d* for each of the colors, usually black, cyan, magenta and yellow is present. Often, in a full-color printer, black marking material is used more frequently in comparison to differently colored marking material. Therefore, more print heads 12*a*-12*d* containing black marking material may be provided on the scanning print carriage 13 compared to print heads 12*a*-12*d* containing marking material in any of the other colors. Alternatively, the print head 12*a*-12*d* containing black marking material may be larger than any of the print heads 12*a*-12*d*, containing a differently colored marking material.

The carriage 13 is guided by guiding means 14, 15. These guiding means 14, 15 may be rods as depicted in FIG. 1B. The rods may be driven by suitable driving means (not shown). Alternatively, the carriage 13 may be guided by other guiding means, such as an arm being able to move the carriage 13. Another alternative is to move the image receiving material 3 in the main scanning direction B.

Each print head 12*a*-12*d* comprises an orifice surface 16 having at least one orifice 17, in fluid communication with a pressure chamber containing fluid marking material provided in the print head 12*a*-12*d*. On the orifice surface 16, a number of orifices 17 is arranged in a single linear array parallel to the sub-scanning direction A. Eight orifices 17 per print head 12*a*-12*d* are depicted in FIG. 1B, however obviously in a practical embodiment several hundreds of orifices 17 may be provided per print head 12*a*-12*d*, optionally arranged in multiple arrays. As depicted in FIG. 1B, the respective print heads 12*a*-12*d* are placed parallel to each other such that corresponding orifices 17 of the respective print heads 12*a*-12*d* are positioned in-line in the main scanning direction B. This means that a line of image dots in the main scanning direction B may be formed by selectively activating up to four orifices 17, each of them being part of a different print head 12*a*-12*d*. This parallel positioning of the print heads 12*a*-12*d* with corresponding in-line placement of the orifices 17 is advantageous to increase productivity and/or improve print quality. Alternatively multiple print heads 12*a*-12*d* may be placed on the print carriage adjacent to each other such that the orifices 17 of the respective print heads 12*a*-12*d* are positioned in a staggered configuration instead of in-line. For instance, this may be done to increase the print resolution or to enlarge the effective print zone, which may be addressed in a single scan in the main scanning direction. The image dots are formed by ejecting droplets of marking material from the orifices 17.

Upon ejection of the marking material, some marking material may be spilled and stay on the orifice surface 16 of the print head 12*a*-12*d*. The ink present on the orifice surface 16, may negatively influence the ejection of droplets and the placement of these droplets on the image receiving member 3. Therefore, it may be advantageous to remove excess of ink from the orifice surface 16. The excess of ink may be removed for example by wiping with a wiper and/or by application of a suitable anti-wetting property of the surface, e.g. provided by a coating.

Figure 2B:
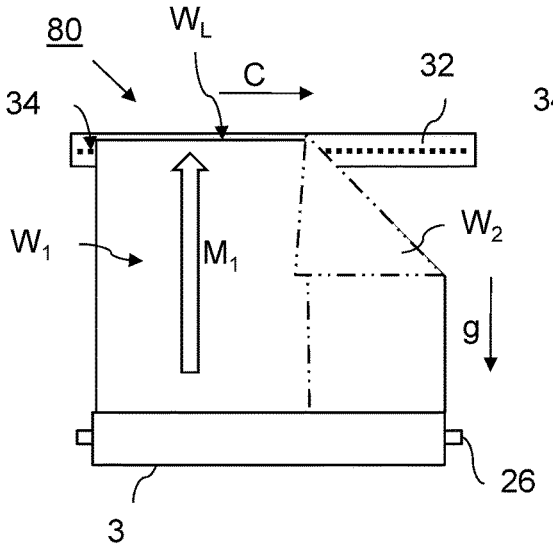

FIG. 2A shows schematically an embodiment of a web transport assembly for transporting a web along a processing unit according to the present invention. The web transport assembly 80 may be used in a printing apparatus 1 shown in FIGS. 1A-1B. FIG. 2A shows a side view of the web transport assembly 80. FIG. 2B shows a plane view on the web transport assembly 80. The web transport assembly 80 comprises a transport device 20, which is a nip comprising a driven roller 22 and a pressure roller 24, and a pick-up device 30. The transport device 20 is arranged downstream of a processing unit 10, such as a print head assembly, and transports a web W along a transport path in a transport direction T. The web is supplied from a roll 3, which is supported by a spindle 26. The web is moved by the transport nip 20 along the transport path from the supply roll 3 along the pick-up device 30, the processing unit 10 towards a receiving roll 50. The receiving roll 50 is supported on a spindle 52. The print head assembly 10 faces a support plate 11, which is arranged to attract the web to the support plate by applying a suction force to a contact side of the web W. The web transport assembly further comprises a control unit 100, which is operatively connected to the print head assembly 10 and to the transport device 20.

The pick-up device 30 is arranged upstream of the support plate 10 and comprises a turn element 31 comprising a pick-up surface 32 for guiding a contact side of the web W while bending the web towards a path over the support plate 11 along the print head assembly 10. As shown in FIGS. 2B-2E, the pick-up device 30 further comprises an array of suction holes 34 distributed over the pick-up surface 32 and arranged along a transverse direction C across to the transport path, which extends in the transport direction T. The pick-up device 30 is operatively coupled to a suction source 40, such as a suction pump, via a tube 42, which communicates a suction pressure to the array of suction holes 34 via a manifold, which is enclosed in the turn element 31. The control unit 100 is operatively connected to the suction source 40 for controlling a suction pressure provided to the contact side of the web via the suction holes 34.

The pick-up surface 32 exerts a friction force onto the contact side of the web W, wherein the friction force is provided in response to the suction force provided to the contact side of the web via the suction holes 34.

Figure 2C:
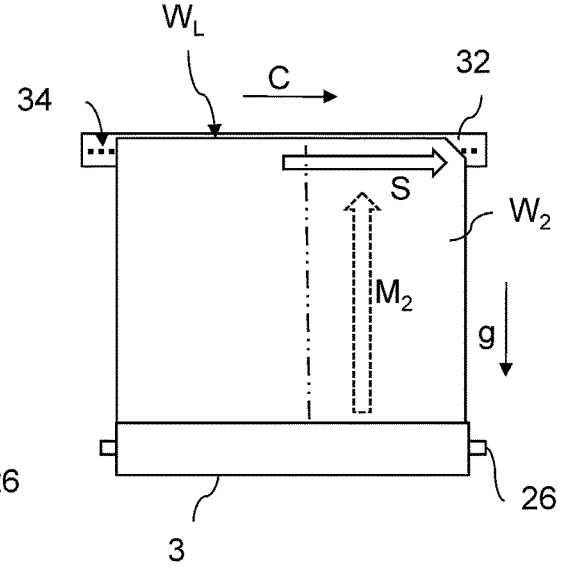

FIGS. 2B and 2C show an embodiment of a method for loading the web W into the transport path of the web transport assembly 80. FIGS. 2B and 2C are both a side view of the web transport assembly 80 seen in a plane of the transport path arranged between the supply roll 3 and the pick-up surface 32. In this embodiment the transport path extends along the gravity direction g and across to the transport path in the transverse direction C. In a first step of the method, the leading end of the web $W_L$ is unwind from the media roll 3 supported by the spindle 26. The leading end of the web $W_L$ may be unwound manually by an operator from the media roll 3, e.g. by pulling the leading end of the web $W_L$, or may be unwound from the media roll 3 by driving the spindle 26. In an example, the spindle 26 may be activated, such as by operating a foot pedal operatively connected to the control unit 100, to unwind the web W from the supply roll 3.

In the first step, as shown in FIG. 2A, a first part of the leading end $W_1$ is manually loaded by the operator by raising the first part of the leading end $W_1$ opposite to the gravity direction g onto the pick-up surface 32, as indicated by arrow $M_1$, wherein the suction holes 34 provide a suction force to the contact side of the web W to hold the first part of the leading end $W_1$ on the pick-up surface 32 by attracting the contact side of the web W. After the first step, the first part of the leading end $W_1$ is held fixed at the pick-up surface 32 by the suction force provided at the pick-up surface 32. At the same time, a second part of the web $W_2$ is allowed to hang in the gravity direction g along the transport path, while being folded away from the pick-up surface 34, as shown in FIG. 2A.

The suction force is provided by a suction pressure generated by the suction source 40. Said suction force may be activated before the first loading step. Alternatively, the suction force may be activated in response to the manually loading step. In an example, a detector is provided for detecting a presence of the web W at the pick-up surface 32 during the media loading. The detector is connected to control unit 100 to provide a signal to the control unit 100 in response to the detection of the web W at the pick-up surface 32. The control unit 100 controls the suction source 40 to increase the suction pressure at the suction holes 34 to hold the first part of the leading end $W_1$ on the pick-up surface 32.

In a second step, as shown in FIG. 2B, a second part of the leading end $W_2$ is manually loaded by the operator by moving the second part of the leading end $W_2$ opposite to the gravity direction g onto the pick-up surface 32, as indicated by arrow $M_2$, wherein the suction holes 34 provide a suction force to the contact side of the web W to hold the second part of the leading end $W_2$ on the pick-up surface 32 by attracting the contact side of the web W, while holding the first part of the leading end $W_1$ on the pick-up surface 32.

In particular, the second part of the leading end $W_2$ is moved towards the pick-up surface 32 by sliding over an outer side of the web along the pick-up surface 32 starting from the first part of the leading end $W_1$ to unfold the second part of the leading end $W_2$ onto the pick-up surface 32, as indicated by arrow S in FIG. 2C. After the second step both the first part of the leading end $W_1$ and the second part of the leading end $W_2$ are held onto the pick-up surface. The operator is now free to move to any other position to further proceed the manual loading of the web W, such as shown in FIG. 2E.

Figure 2D:
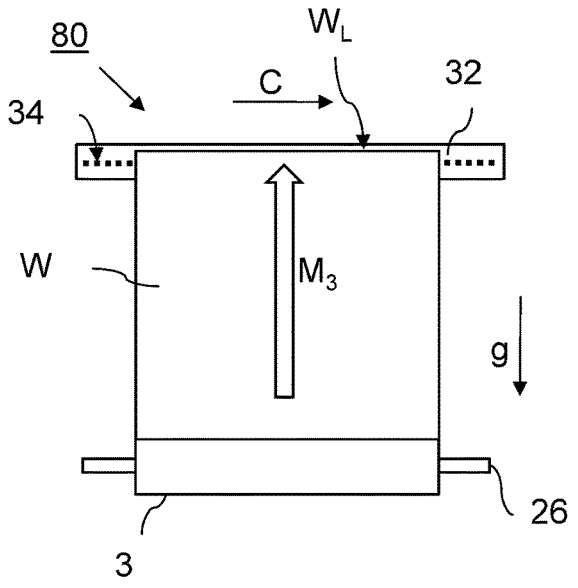

FIG. 2D shows another embodiment of a method for loading the web W into the transport path of the web transport assembly 80. FIG. 2D is a side view of the web transport assembly 80 seen in a plane of the transport path arranged between the supply roll 3 and the pick-up surface 32. In this embodiment the transport path extends along the gravity direction g and across to the transport path in the transverse direction C. In a first step of the method, the leading end of the web $W_L$ is unwind from the media roll 3 supported by the spindle 26. The leading end of the web $W_L$ may be unwound manually by an operator from the media roll 3, e.g. by pulling the leading end of the web $W_L$, or may be unwound from the media roll 3 by driving the spindle 26.

Figure 2E:
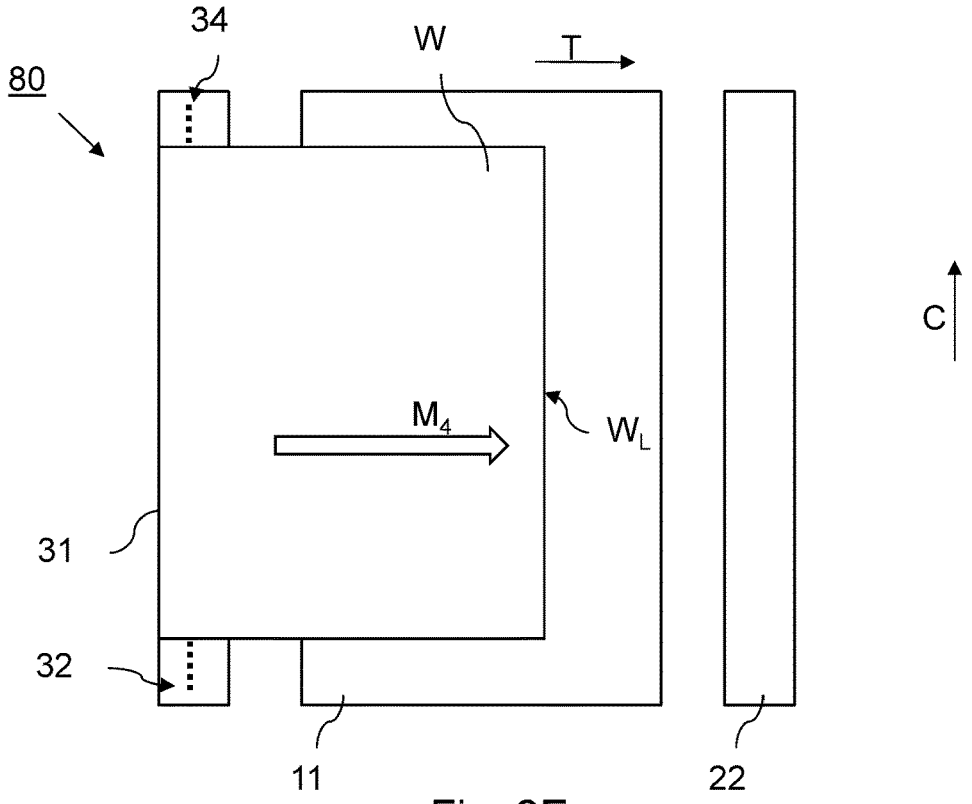

In the first step, as shown in FIG. 2E, a the leading end of the web $W_L$ is manually loaded by the operator by raising the leading end opposite to the gravity direction g onto the pick-up surface 32, as indicated by arrow $M_3$, wherein the suction holes 34 provide a suction force to the contact side of the web W to hold the leading end $W_L$ on the pick-up surface 32 by attracting the contact side of the web W. After the first step, the whole leading end $W_L$ is held fixed at the pick-up surface 32 by the suction force provided at the pick-up surface 32. In an example of this embodiment, a width of the web W across to the transport path along the transverse direction C is not wider than a range wherein the operator can reach by using his hands. After the first step, the operator is free to move to any other position to further proceed the manual loading of the web W, such as shown in FIG. 2E.

FIG. 2E shows a further step of the embodiments shown in FIGS. 2B-2C and FIG. 2D. FIG. 2E is a plane view on the transport path over the support plate 11. In the next step, the leading end of the web $W_L$ is threaded by the operator from the pick-up surface 32 through the transport path over the support plate 11 along the processing unit 10 towards the driven roller 22 of the transport device. During the threading step the processing unit 10 may be moved away from the support plate 11, such as sideways in the transverse direction C. At the start of the threading step, the suction force at the suction holes 34 is deactivated, such as removed or at least reduced, to release the leading end of the web $W_L$ from the pick-up surface 32. In this way, the threading of the leading end of the web through the transport path beyond the pick-up surface is supported. In an example, the operator may deactivate the attraction mechanism, such as by providing an operator input to a control unit for controlling the attraction mechanism. Alternatively, the attraction mechanism may be deactivated automatically by a control unit, such as in response to a predetermined holding time.

Furthermore, during the threading step, the spindle 26 may be activated, such as by operating a foot pedal operatively connected to the control unit 100, to unwind the web W from the supply roll 3.

In a modified embodiment of the embodiment of the web transport assembly shown in FIGS. 2A-2E, the pick-up device 30 is a friction-based tensioning device 30, which is configured for further controlling a tension of the web W along the transport path between the guiding surface 32 of the friction-based tensioning device 30 and the transport nip 20 during a normal transport operation of the web through the transport path after the media loading steps shown in FIGS. 2B-2E.

In transport operation, the transport nip 20 transports the web W along the transport path in the transport direction T, such as by intermittently moving the web W in the transport direction T. As the transport nip 20 drives the web W in the transport direction T, the friction-based tensioning device 30 controls the tension of the web W in the transport direction T by controllably restraining the web in the transport direction T.

Figure 3A:
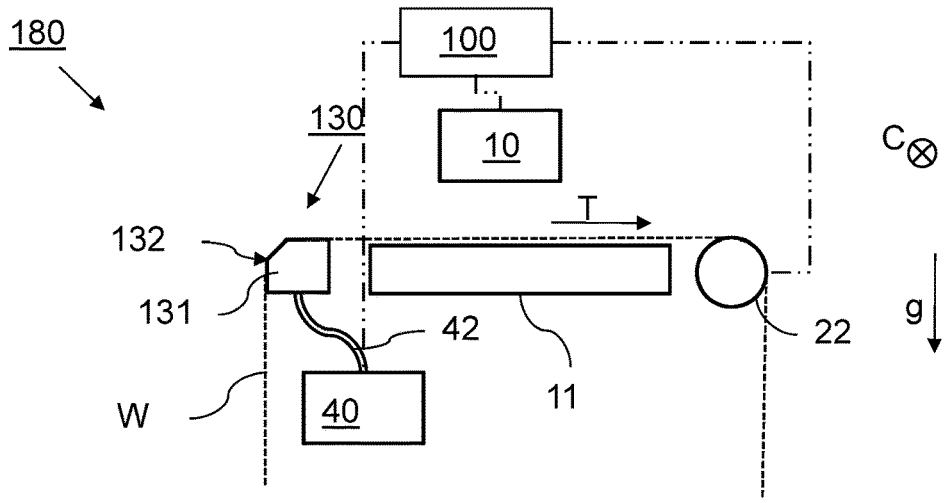
FIGS. 3A and 3B show schematically another embodiment of a web transport assembly for transporting a web along a processing unit according to the present invention.
Figure 3B:
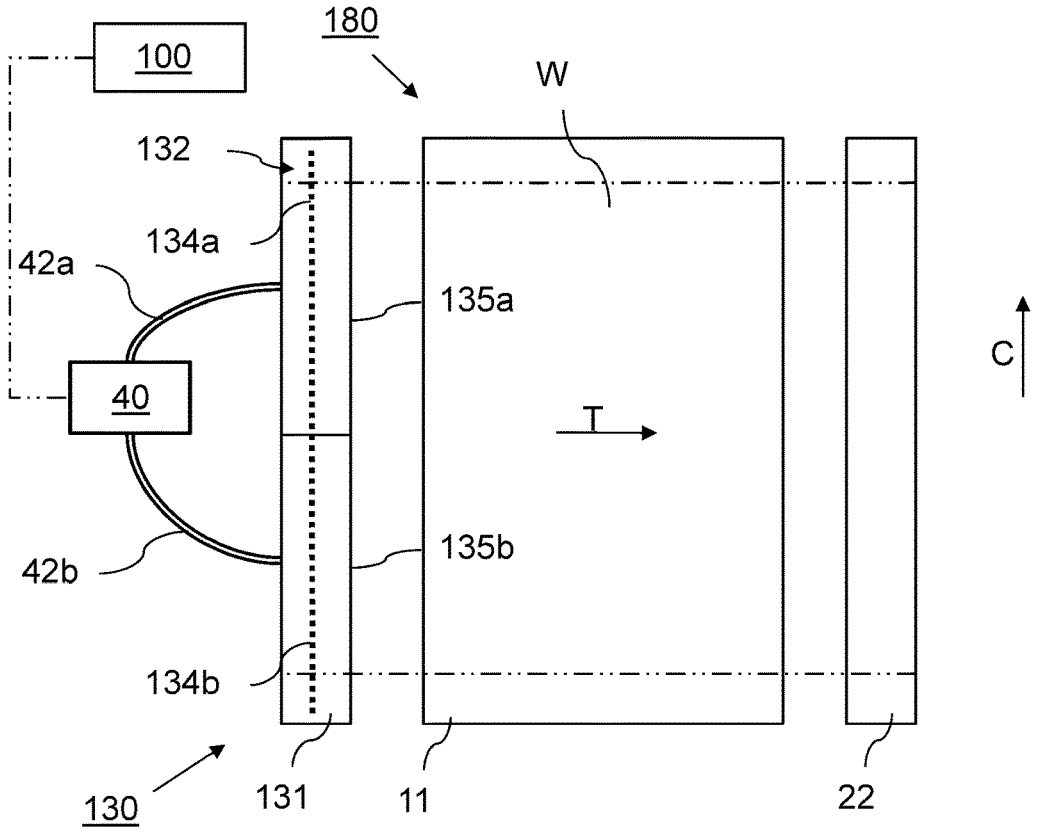

FIGS. 3A and 3B show schematically another embodiment of a web transport assembly for transporting a web along a processing unit according to the present invention. The web transport assembly 180 may be used in a printing apparatus 1 shown in FIGS. 1A-1B.

FIG. 3A shows an enlarged side view of the web transport assembly 180. FIG. 3B shows a plane view on the web transport assembly 180. The web transport assembly 180 comprises a transport roller 22, a friction-based tensioning device 130 and a control unit 100. The transport roller 22 is a driven roller, which is controlled by the control unit 100, for transporting the web w along a transport path in a transport direction T along a processing unit 10, which faces a support plate 11.

The friction-based tensioning device 130 comprises a turn bar 131, which is stationary arranged relative to the transport path and comprises a guiding surface 132 for guiding a contact side of the web W while bending the web towards a path over the support plate 11 along the processing unit 10. The guiding surface 132 comprises a plurality of suction holes 134*a*-134*b* arranged along a transverse direction C across to the transport path, which extends in the transport direction T.

The plurality of suction holes 134*a*-134*b* comprises two segments 134*a*-134*b* arranged adjacent one another along the transverse direction C. Each segment 134*a*-134*b* of the plurality of suction holes is connected to a manifold 135*a*-

135*b*, respectively, which is provided inside the turn bar 131 and arranged adjacent one another along the transverse direction C.

Each manifold 135*a*-135*b* is of the friction-based tensioning device 130 is operatively coupled to a suction source 40, such as a suction pump, via a tube 42*a*-42*b*, respectively, which communicates a suction pressure to the segment of suction holes 134*a*-134*b* via the manifold 135*a*-135*b*, which is enclosed in the turn element 131.

The control unit 100 is operatively connected to the suction source 40 for controlling a suction pressure provided to the contact side of the web W via the segments of suction holes 134*a*-134*b* at each segment independently one another.

The guiding surface 132 exerts a friction force onto the contact side of the web W, wherein the friction force is provided in response to the suction force provided to the contact side of the web at each of the segments via the suction holes 134*a*-134*b*. As the suction force is controlled of each segments of the suction holes 134*a*-134*b* independently one another, the tension of the web W can be adjusted for each segment along the transverse direction C.

In an example, any differences in tension of the web W along the transverse direction C, such as due to variations of the web W and/or the guiding surface along the transverse direction C, can be minimized by applying different suction forces to the segments of the suction holes 134*a*-134*d*.

Alternatively or additionally, a difference in tension of the web W along the transverse direction C may be induced by applying different suction forces to the segments of the suction holes 134*a*-134*d* in order to steer the web W with respect to the transport path. In an example, suction force by the left manifold segment 135*a* may be increased relative to the right manifold segment 135*b*. As a result, the friction induces on the web W by the guiding surface 132 at the segment 135*a* is higher than the friction induces on the web W by the guiding surface 132 at the segment 135*b*. In this way, the tension of the web W at the left side is higher than the tension of the web W at the right side, relative to the transport direction T, thereby rotating the web C counter-clockwise when looking from above in the plane view of FIG. 3B.

In yet another use of the web transport assembly 180 (not shown), a first web and a second web may be transported alongside one another along the transport path. The first web may be arranged at the left side of the transport path in contact with the guiding surface 132 at the segment of the suction holes 134*a*. The second web may be arranged at the right side of the transport path in contact with the guiding surface 132 at the segment of the suction holes 134*b*. The tension of the first web may be controlled by the segment of the suction holes 134*a* of the friction-based tensioning device 130, while the tension of the second web may be controlled by the segment of the suction holes 134*b* of the friction-based tensioning device 130. In this way, the friction-based tensioning device 130 supports a tandem processing of the first web and second web alongside one another while controlling a tension of each web independently one another.

Figure 4A:
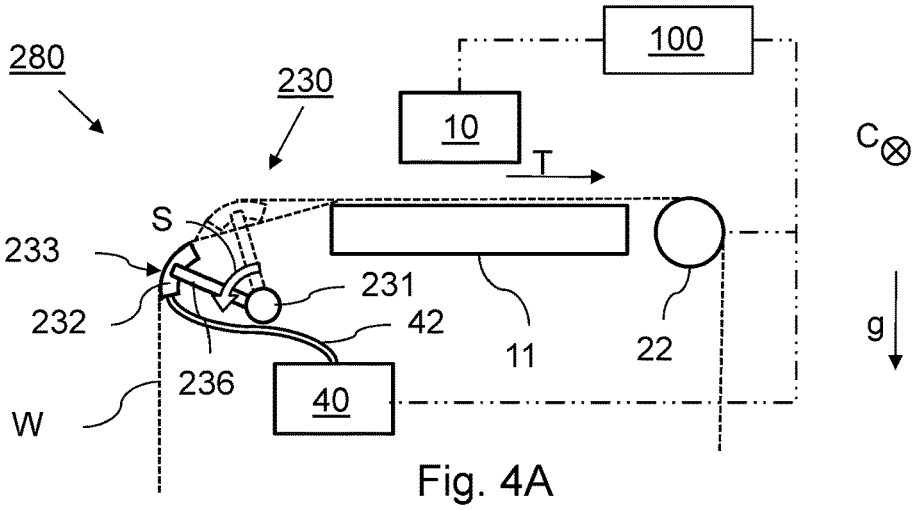
FIGS. 4A-4B show schematically another embodiment of a web transport assembly for transporting a web along a processing unit according to the present invention.
Figure 4B:
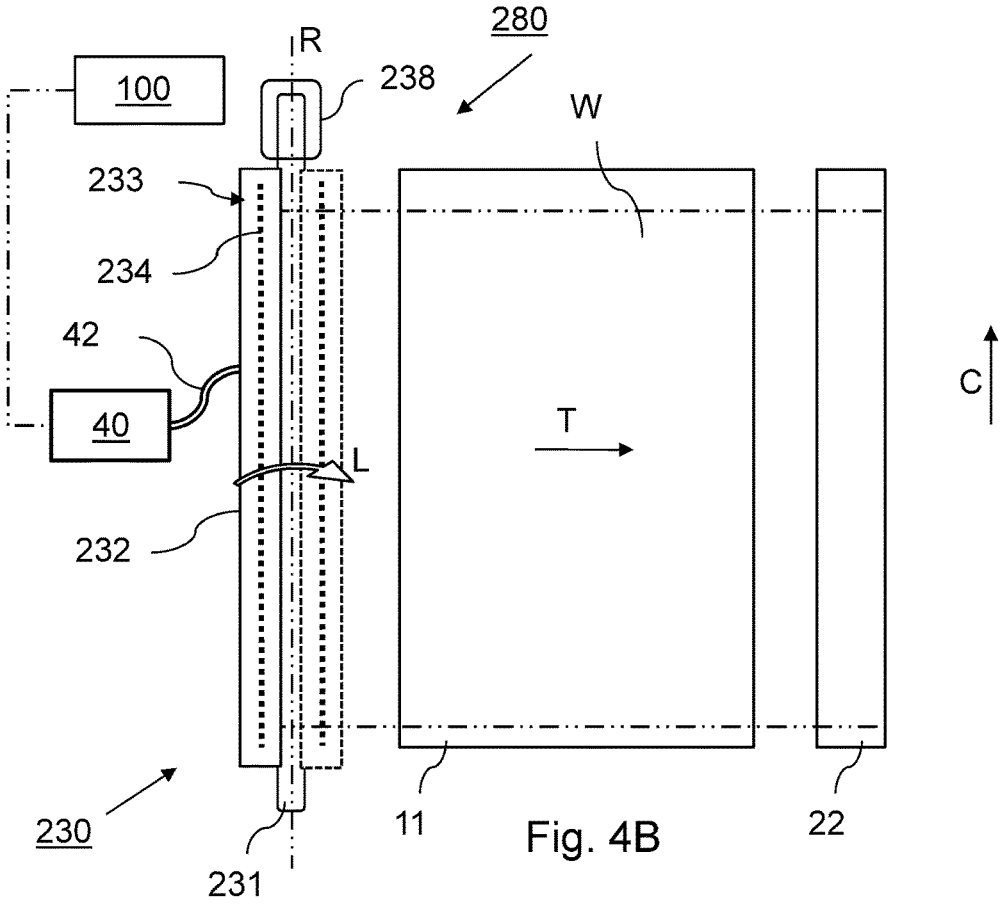

FIGS. 4A-4B show schematically another embodiment of a web transport assembly for transporting a web along a processing unit according to the present invention. The web transport assembly 280 may be used in a printing apparatus 1 shown in FIGS. 1A-1B.

FIG. 4A shows an enlarged side view of the web transport assembly 280. FIG. 4B shows a plane view on the web transport assembly 280. The web transport assembly 280 comprises a transport roller 22, a friction-based tensioning device 230 and a control unit 100. The transport roller 22 is a driven roller, which is controlled by the control unit 100, for transporting the web w along a transport path in a transport direction T along a processing unit 10, which faces a support plate 11.

The friction-based tensioning device 230 is a rotatable lever assembly, which comprises a shaft 231, a guiding plate 232, a lever element 236 and a spring mechanism 238 (shown in FIG. 4B). The shaft 231 coincides with a rotation axis R of the rotatable lever assembly 230. The rotation axis R is arranged extending parallel to the transverse direction C across to the transport path. The guiding plate 232 comprises a guiding surface 233 for guiding a contact side of the web W. The lever element 236 connects the guiding plate 232 to the shaft 231. As such, the guide plate 232 is rotatably arranged around the rotation axis R of the rotatable lever assembly 230. The guiding plate 232 is rotatable around the rotation axis between a first rotation position (solid line) and a second rotation position (dashed line).

The spring mechanism 238 is coupled to the lever assembly 230 via the shaft 231 and exerts a torque force onto the guiding plate 232 via the lever element 236. The torque force depends on the rotation angle of the lever element 236 around the rotation axis. Furthermore, the torque force depends on a length of the lever element 236 between the shaft 231 and the guiding plate 232. The torque force is directed in a direction as indicated by arrow S such to restrain a rotation of the guiding plate 232.

The guiding surface 233 is arranged for guiding a contact side of the web W while bending the web towards a path over the support plate 11 along the processing unit 10. The guiding surface 233 comprises an array of suction holes 234 arranged along a transverse direction C across to the transport path, which extends in the transport direction T. Alternatively, the guiding surface 233 may comprise a plurality of arrays of suction holes 234 (not shown), each array being arranged along a transverse direction C across to the transport path.

The friction-based tensioning device 230 is operatively coupled to a suction source 40, such as a suction pump, via a tube 42, which communicates a suction pressure to the array of suction holes 234 via a manifold, which is enclosed in the guiding plate 232. The control unit 100 is operatively connected to the suction source 40 for controlling a suction pressure provided to the contact side of the web via the suction holes 234. The web W is attracted to the guiding surface 233 of the guiding plate 232 by a suction force provided to the contact side of the web. In case the web W is moved in the transport direction T by the transport roller 22, the guiding plate 232 of the lever assembly 230 moves in an arched way long the transport path by rotation about the rotation axis as schematically indicated by arrow L in FIG. 4, such as from the first rotation position (solid line) to the second rotation position (dashed line). As a result, the torque force provided by the spring mechanism 238 increases, thereby increasing the tension of the web W in the transport direction T.

At the rotation position of the guiding plate 232, where the tension of the web W reaches a level equal to the friction force provided at the guiding surface 233 to the contact side of the web W, the web W starts sliding along the guiding plate 232 in the transport direction. As a result, the tension of the web is controlled to be constant, while the guiding plate 232 is held substantially stationary with respect to the transport path, thus at a constant rotation angle about the rotation axis. At this rotation angle the torque force at the guiding surface 233 of the guiding plate 232 is equal to and in opposite direction to the friction force applied by the guiding surface 233 to the web W.

The tension of the web W can easily be adjusted by adjusting the suction force provided to the web W at the guiding surface 233. When the suction force is adjusted, such as decreased, the friction force applied by the guiding surface 233 to the web W decreases. As a result, the spring element 238 will rotate the guiding plate 232 counter-clock wise (as shown in FIG. 4A). Thereby, the torque force provided by the spring mechanism 238 will decrease accordingly. The guiding plate 232 and the lever element 236 will obtain another rotation angle about the rotation axis, wherein a lower torque force balances the lower friction force at the guiding surface 233. As such, a rotation angle of the lever element 236 provides a measure of the torque force of the spring mechanism 238 and, when the web is engaged by the guiding surface 233, of the tension of the web W in the transport direction T.

Figure 5:
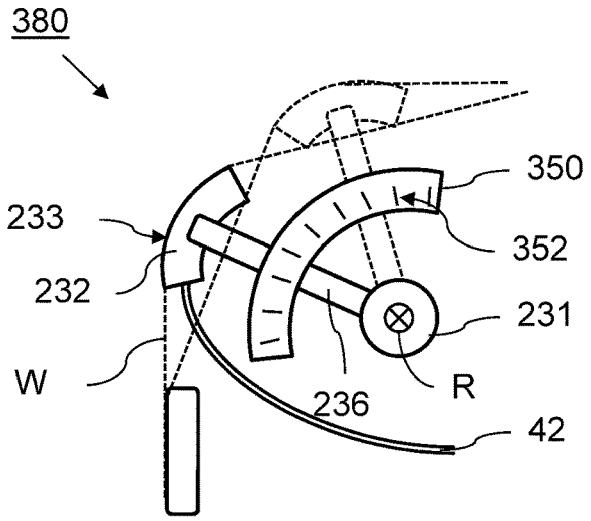
FIG. 5 shows a modified friction-based tensioning device of the embodiment shown in FIGS. 4A-4B.

FIG. 5 shows a modified friction-based tensioning device of the embodiment shown in FIGS. 4A-4B. FIG. 5 shows an enlarged side view of the web transport assembly 380. The modified friction-based tensioning device 330 comprises the lever assembly shown in FIGS. 4A-4B and additionally comprises a rotation angle measuring device 350. The rotation angle measuring device 350 comprises a rotation scale 352 mounted to the lever assembly 330. The rotation scale 352 comprises a plurality of marks for indicating a rotation angle of the lever element 236 including the guiding plate 232 about the rotation axis R which coincides with the shaft 231. The rotation scale 352 is configured to be readable by an operator. The rotation angle of the lever element 236 about the rotation axis R is a measure of the tension of the web w in the transport direction T.

In an alternative example, the lever assembly 330 may be provided with a rotatable encoder and a sensor (not shown). The rotatable encoder is mounted on the shaft 231 and comprises a plurality of marks for indicating a rotation angle of the lever element 236 including the guiding plate 232 about the rotation axis R which coincides with the shaft 231. The sensor is arranged for detecting the marks on the rotatable encoder and to send a sensor signal to the control unit 100 for indicating the rotation angle of the lever element 236 including the guiding plate 232 about the rotation axis R. In this way, the control unit 100 may determine the tension of the web W based on the detected rotation angle of the lever element 236.

Figure 6:
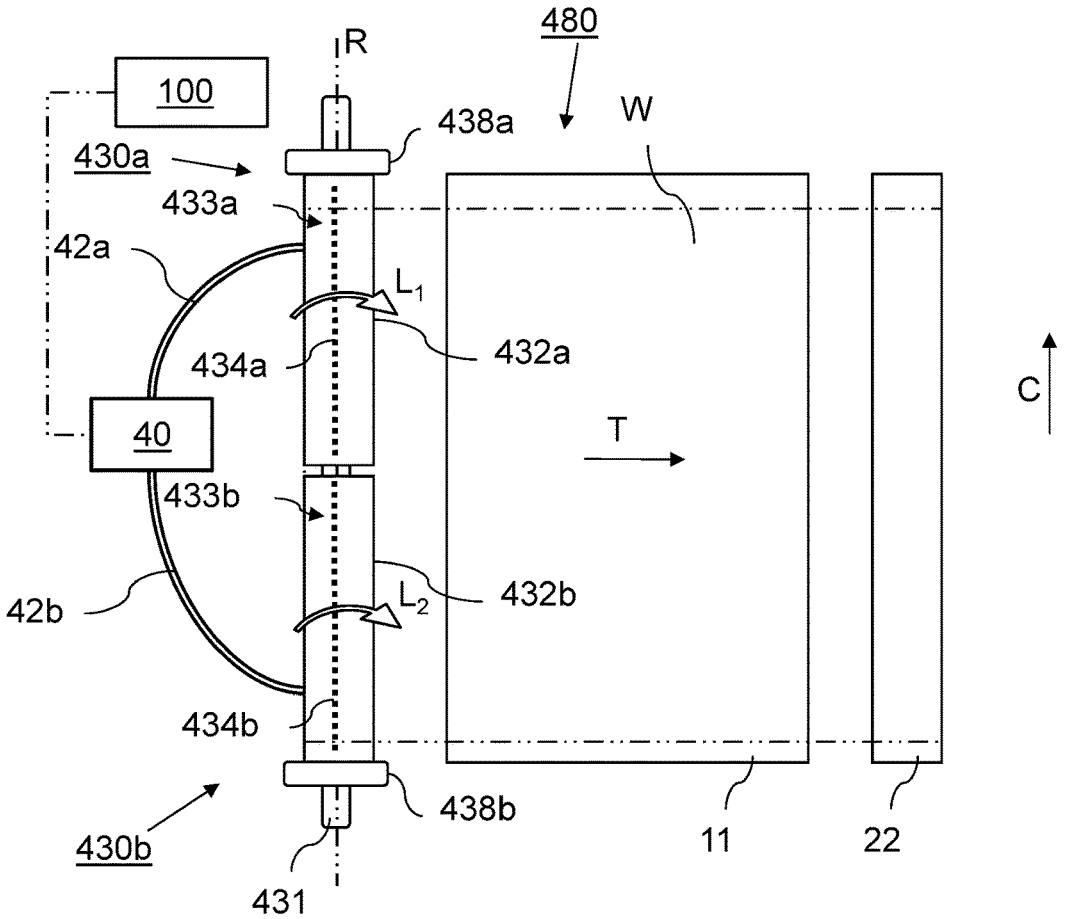
FIG. 6 shows a plane view of another modified friction-based tensioning device of the embodiment shown in FIGS. 4A-4B.

FIG. 6 shows a plane view of another modified friction-based tensioning device of the embodiment shown in FIGS. 4A-4B. The modified friction-based tensioning device 430 comprises the rotatable lever assembly 330 shown in FIGS. 4A-4B, wherein the lever assembly 430 comprises a shaft 431, a first lever segment 430*a* and a second lever segment 430*b*. The first lever segment 430*a* and a second lever segment 430*b* are arranged alongside one another in the transverse direction C across to the transport path. Each of the first lever segment 430*a* and a second lever segment 430*b* is rotatable around the shaft 431 independently one another, as schematically indicated by arrows $L_1$ and $L_2$ in FIG. 6.

Each lever segment 430*a*-403*b* comprises a lever element (as shown in FIG. 4A) and a guiding plate 432*a*-432*b*. The lever element connects the guiding plate 432*a*-432*b* to the shaft 231. Each guiding plate 432*a*-432*b* comprises a guiding surface 433*a*-433*b* for guiding the web W and a plurality of suction holes 434*a*-434*b* for providing a suction force to a contact side of the web W to control a friction force of the guiding surface 433*a*-433*b*, respectively, to the web W. The spring mechanism 438 controls a torque force provided to each of the lever segments 430*a*-403*b* around the rotation axis R, which coincides with the shaft 431, independently one another by way of a spring element 438*a*-438*b*, respectively, which is connected to one of the lever elements (shown in FIG. 4A), respectively.

Each guide plate 432*a*-432*b* is operatively coupled to a suction source 40, such as a suction pump, via a tube 42*a*-42*b*, respectively, which communicates a suction pressure to the segment of suction holes 434*a*-434*b*, respectively. The control unit 100 is operatively connected to the suction source 40 for controlling a suction pressure provided to the contact side of the web W via the suction holes 434*a*-434*b* at each lever segment independently one another.

The guiding surface 433*a*-433*b* of each lever segment exerts a friction force onto the contact side of the web W, wherein the friction force is provided in response to the suction force provided to the contact side of the web at each of the lever segments via the suction holes 434*a*-434*b*.

As the suction force is controlled of the suction holes 434*a*-434*b* of each lever segment 430*a*-430*b* independently one another, the tension of the web W can be adjusted for each lever segment 430*a*-430*b* along the transverse direction C.

In this way, the tension of the web W in the transport direction T may be varied along the transverse direction C by the spring mechanism 438.

Figure 7:
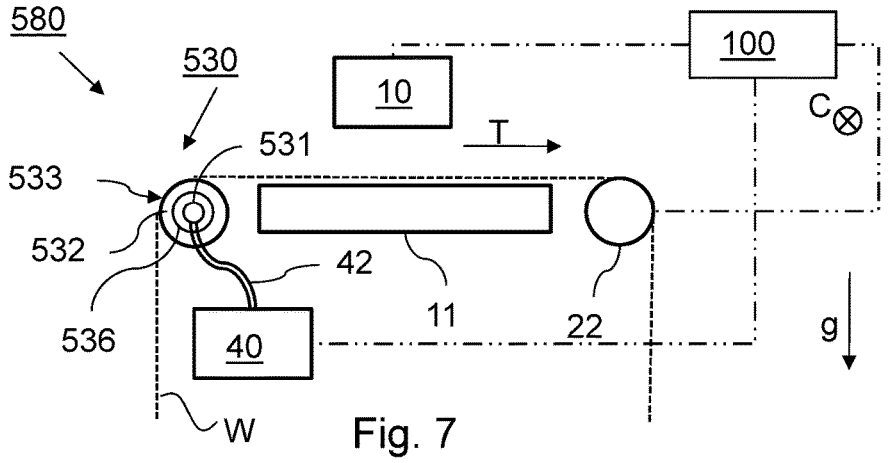
FIG. 7 show schematically another embodiment of a web transport assembly for transporting a web along a processing unit according to the present invention.

FIG. 7 show schematically another embodiment of a web transport assembly for transporting a web along a processing unit according to the present invention. The web transport assembly 580 may be used in a printing apparatus 1 shown in FIGS. 1A-1B.

FIG. 7 shows an enlarged side view of the web transport assembly 580. FIG. 4B shows a plane view on the web transport assembly 580. The web transport assembly 580 comprises a transport roller 22, a friction-based tensioning device 530 and a control unit 100. The transport roller 22 is a driven roller, which is controlled by the control unit 100, for transporting the web W along a transport path in a transport direction T along a processing unit 10, which faces a support plate 11.

The friction-based tensioning device 530 is a rotatable roller 532 comprising a guiding surface 533 at its circumference. The roller 532 is mounted on a shaft 531, which coincides with the rotation axis of the roller 532. The roller 532 further comprises suction holes 534 distributed over the guiding surface 533 for providing a suction force to a contact side of the web W, while the guiding surface 533 of the roller 530 is in rolling contact to the contact side of the web W. For this purpose, the suction holes 534 are distributed over the guiding surface 533 along the circumference direction of the roller 530.

The suction holes 533 are connected to a suction source 40 via a tube 42. The suction source 40 provides a suction pressure to the suction holes 534 for attracting the web onto the guiding surface 533. The control unit 100 is operatively connected to the suction source 40 for controlling a suction pressure provided to the contact side of the web via the suction holes 534.

The friction-based tensioning device 530 further comprises a friction mechanism 536 coupled to the shaft 531 of the rotatable roller 532. The friction mechanism 536 is a journal bearing, which is configured for controlling a friction force acting on the shaft 531 for restraining a rotation of the roller 532 around its rotation axis. The control unit 100 is operatively connected to the friction mechanism 536 for controlling the friction force acting on the shaft 531.

The friction force provided to the contact side of the web W via the guiding surface 533 is selected higher than the friction force provided by the friction mechanism 536 onto the shaft 531 of the roller 532. As such, the web pulls the roller 532, thereby driving a rotation of the roller 532 around its rotating axis, when the web W is moved in the transport direction T along the transport path by the transport roller 22.

In this way, the friction mechanism 536 determines the tension of the web W, when the roller 532 is held in rolling contact to the contact side of the web W.

Figure 8:
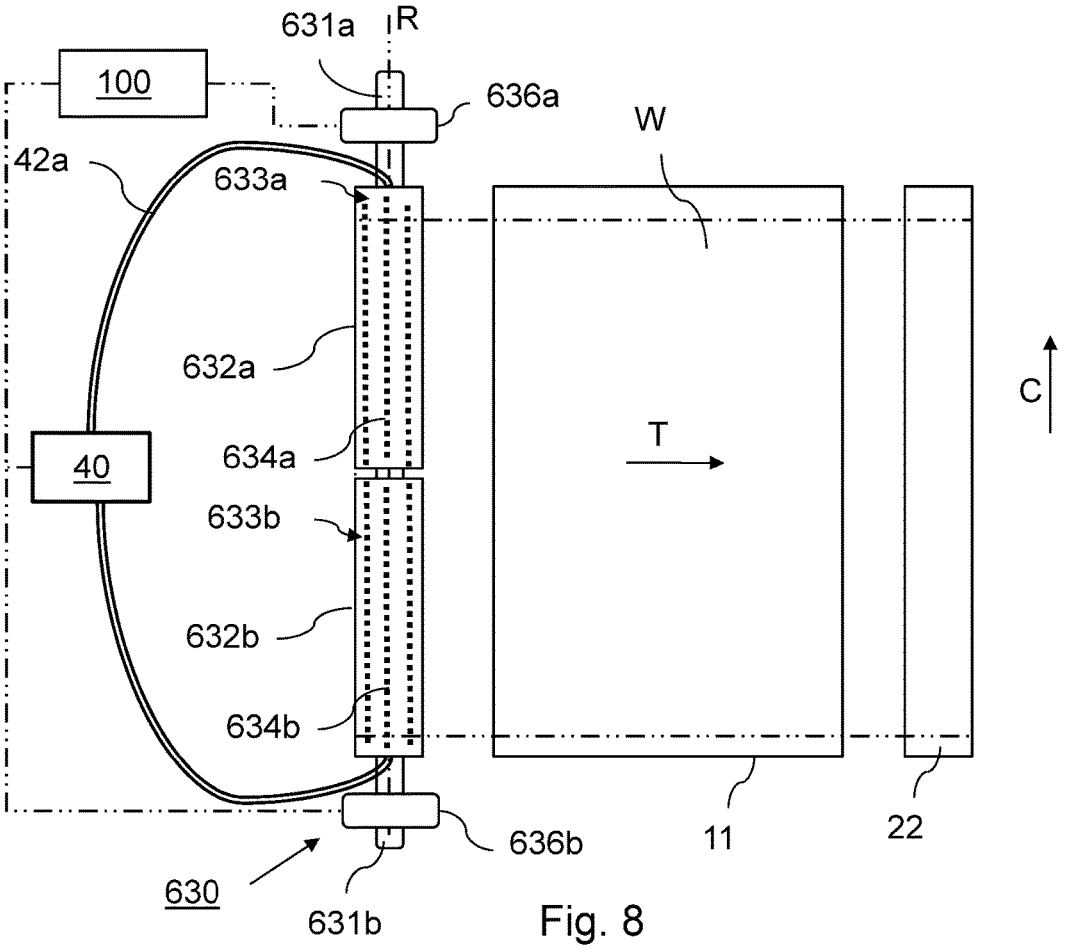
FIG. 8 shows a plane view of a modified friction-based tensioning device of the embodiment shown in FIG. 7.

FIG. 8 shows a plane view of a modified friction-based tensioning device of the embodiment shown in FIG. 7. In the modified friction-based tensioning device 630, the rotatable roller 630 comprises a first roller segment 632*a* and a second roller segment 632*b*. The first roller segment 632*a* and a second roller segment 632*b* are arranged alongside one another along a transverse direction C across to the transport path. The first roller segment 632*a* and a second roller segment 632*b* are rotatably mounted on a first shaft 631*a* and a second shaft 631*b* independently one another. The first shaft 631*a* and second shaft 631*b* are both arranged coinciding with a mutual rotation axis R. Each of the roller segments 632*a*-632*b* has a guiding surface 633*a*-633*b* arranged at its circumference and comprises suction holes 634*a*-634*b* distributed over the guiding surface 633*a*-633*b* over the whole circumference of the roller segments 632*a*-632*b*, respectively, for providing a suction force to a contact side of the web W. The suction holes 634*a*-634*b* are connected to a suction source 40 via a tube 42*a*-42*b*, respectively. The suction source 40 provides a suction pressure to the suction holes 634*a*-634*b* for attracting the web onto the guiding surface 633*a*-633*b*. The control unit 100 is operatively connected to the suction source 40 for controlling a suction pressure provided to the contact side of the web via the suction holes 634*a*-634*b* of the first roller segment 632*a* and a second roller segment 632*b* independently one another.

The friction-based tensioning device 630 comprises a first journal bearing 636*a* and a second journal bearing 636*b*. The first journal bearing 636*a* is coupled to the first shaft 631*a* for control a friction force acting on the first shaft 631*a* for restraining a rotation of the first roller segment 632*a*. The second journal bearing 636*b* is coupled to the second shaft 631*b* for control a friction force acting on the second shaft 631*b* for restraining a rotation of the second roller segment 632*b*.

The control unit 100 is operatively connected to the first journal bearing 636*a* and the second journal bearing 636*b* for adjusting the friction force acting on the shafts 631*a*-631*b*, respectively, independently one another.

In this way, the tension of the web W in the transport direction T at both sides of the web W across the transport path may be controlled by each roller segment 632*a*-632*b* independently one another.

Figure 9A:
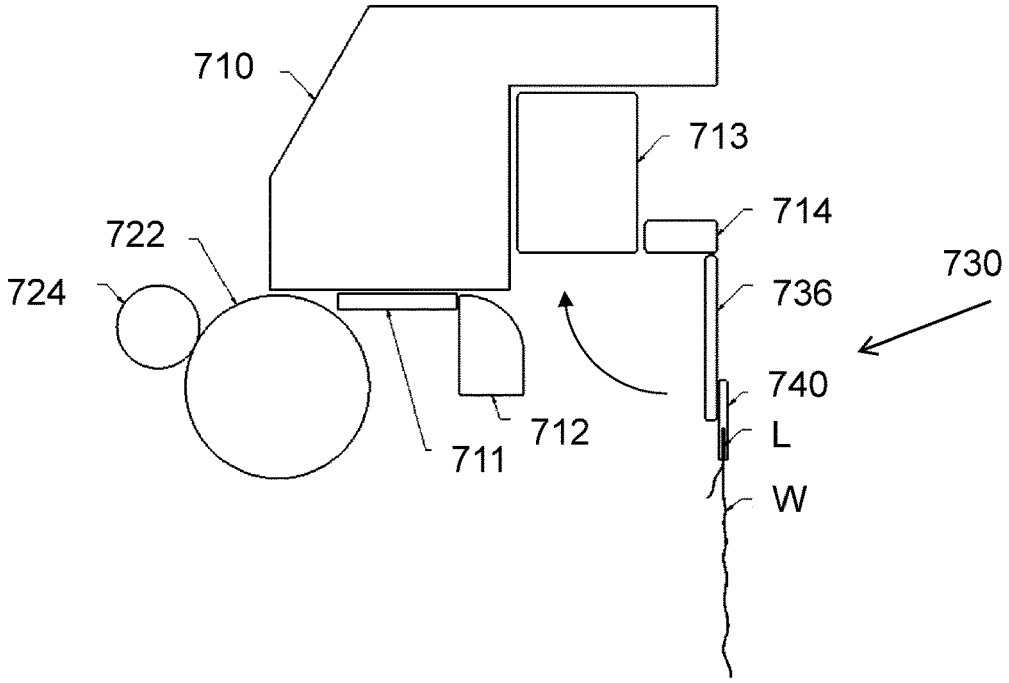
FIGS. 9A-B show schematically another embodiment of an image forming apparatus according to the present invention.
Figure 9B:
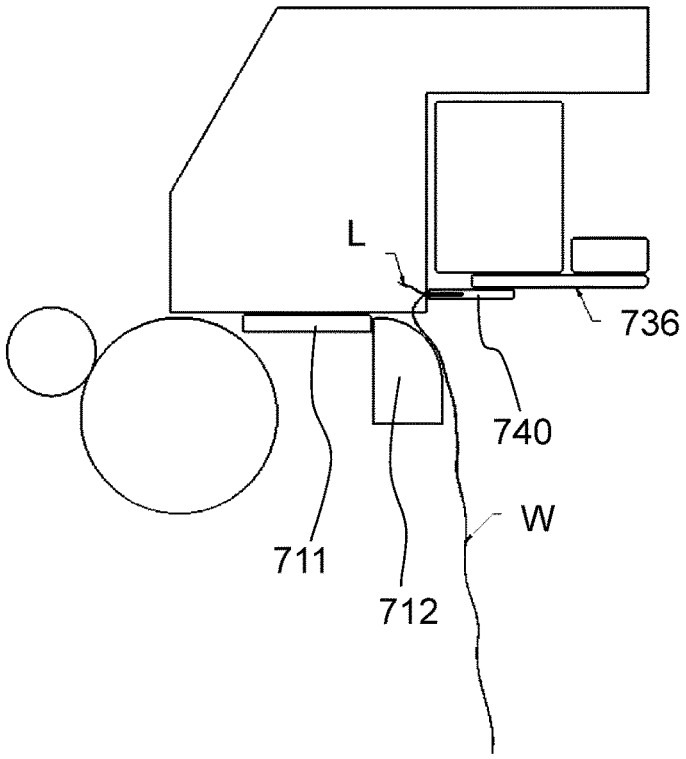

FIG. 9 A shows a further embodiment, wherein the lever 736 is provided as a media cover plate 736. The media loading cover 736 in the first position shown in FIG. 9A shields part of the web W on the transport path from accidental access e.g. by an operator. The media cover plate 736 is pivotably connected to the support beam 713 via intermediate element 714. The support beam 713 moveably supports the translating print carriage 710. The free end of the media cover plate 736 is provided with a holding mechanism 740 in the form of a clamp 740. The intermediate element 714 positions the media cover plate 736 such that in the first position in FIG. 9A the holding mechanism is positioned near the supply unit (now shown). This allows for easy attachment of the leading edge section L of the web W to the holding mechanism 740. After securing the leading edge section L to the holding mechanism 740, the media cover plate 736 is pivoted to its second position shown in FIG. 9B. The intermediate element 714 positions the media cover plate 736 such that in the second position in FIG. 9B the holding mechanism 740 is positioned near the upstream end of the print surface 711. The pivot axis of the media cover plate 736 is thereby positioned above the transport path. The distance between the transport path and the pivot axis is preferably at least the length of the lever or plate 736. Thereby the horizontal spacing between the surfaces 711, 712 and the pivot axis is sufficient to let the media cover plate 736 pass unhindered along the surfaces 711, 712. This further allows the media cover plate 736 to hang freely in the first position without overlapping the transport path. In FIG. 9B a curved support surface 712 is positioned at this upstream end. The curved support surface 712 guides the web W from a vertical to a horizontal orientation on the print surface 711. The curved surface 712 may be a stationary curved plate 712 or a roller. The leading edge section L attached to the media cover plate 736 is thereby easily brought from the supply unit to the print surface 711. Preferably, the upwards pivoting of the media cover plate 736 is aided by an urging device such as a spring or one or more gas struts, such that the operator may raise the web medium W to the print surface 711 with relatively little effort. The urging devices are preferably configured to drive the media cover plate 736 to one of the first and the second positions as the media cover plate passes halfway through the angle between the two positions. Dependent on the direction of motion, i.e. upwards or downwards, the urging device forces the media cover plate into the respective position after an initial push by the operator in the respective direction. In the second position in FIG. 9B, the leading edge section L is released from the holding mechanism 740 and positioned onto the print surface 711 or the curved surface 712. From there the web is fed to the receiving roller (not shown) downstream of the print surface 711. After loading, the media cover plate is returned to its first position shown in FIG. 9A wherein it protects the web medium W from damage and contamination. The media cover plate 736 is preferably a page-wide plate extending over the width of the transport path. The holding mechanism 740 need only engage the web at sufficient positions to facilitate a secure holding of the web during the pivoting of the media cover plate 736.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An apparatus for handling a web comprising a processing unit for processing the web and a web transport assembly for transporting the web through a transport path along the processing unit, the web transport assembly comprising:

a supply unit arranged for mounting a media roll and for supplying the web from the media roll to the transport path;

a pick-up device comprising a pick-up surface and a holding mechanism configured for releasably holding a leading edge section of the web onto the pick-up surface, wherein the pick-up device is moveable between a first position for attaching the leading edge section to the pick-up device and a second position positioned at an upstream end of a web supporting surface below the processing unit, and wherein the first position is below the second position when the pick-up device is in use.

2. The apparatus according to claim 1, wherein the pick-up surface is provided at an end of a pivotable lever.

3. The apparatus according to claim 2, wherein the lever is pivotable around a shaft extending in the lateral direction of the transport path.

4. The apparatus according to claim 2, wherein the lever when in use is positioned above the transport path.

5. The apparatus according to claim 1, wherein the holding mechanism comprises a clamp for clamping the leading edge section.

6. The apparatus according to claim 1, wherein the processing unit comprises a support plate and wherein the pick-up device is positioned upstream of the support plate.

7. The apparatus according to claim 1, further comprising:

an attraction mechanism configured for attracting a contact side of the web onto the pick-up surface; and a control unit configured for, during media loading, controlling the attraction mechanism to hold the leading end of the web onto the pick-up surface, wherein the control unit is configured for deactivating the attraction mechanism to release the leading end of the web from the pick-up surface in response to an operator input.

8. The apparatus according to claim 7, wherein the control unit comprises a user interface for inputting the operator input for deactivating the attraction mechanism.

9. The apparatus according to claim 7, wherein the attraction mechanism comprises a suction source for providing a suction pressure and a plurality of suction holes distributed over the pick-up surface and operatively connected to the suction source for providing the suction pressure to the contact side of the web to hold the leading end of the web.

10. The apparatus according to claim 1, wherein the pick-up surface is positioned at a height level higher than the supply unit when viewed in the direction of gravity.

11. The apparatus according to claim 1, wherein the web transport assembly further comprises a transport device arranged for moving the web through the transport path, and a control unit configured to activate the transport device to drive the web after releasing the leading end of the web from the pick-up surface.

12. The apparatus according to claim 1, wherein the pick-up surface is arranged at a height level being substantially equal to a height level of the processing unit relative to a height direction.

13. The apparatus according to claim 1, wherein the web transport assembly further comprises a foot pedal operable by the operator and operatively connected to the control unit for activating the supply unit to unwind the web from the media roll.

14. A method for loading a web into a transport path, comprising the steps of:

i) providing the apparatus according to claim 1 for loading the web into the transport path of the apparatus;

ii) mounting a media roll into the supply unit;

iii) manually loading by an operator a first part of the leading end of the web onto the pick-up surface, the holding mechanism holding the first part of the leading end of the web on the pick-up surface;

iv) controlling the holding mechanism to release the leading end of the web from the pick-up surface;

v) threading the leading end of the web from the pick-up surface through the transport path and beyond the processing unit.

15. The method according to claim 14, wherein step iii) comprises activating the supply unit to unwind the leading end of the web from the media roll.

16. The method according to claim 15, wherein the method further comprises the step of:

vi) manually loading by an operator a second part of the leading end of the web onto the pick-up surface, the attraction mechanism holding the second part of the leading end of the web on the pick-up surface by attracting the contact side of the web.

17. The method according to claim 16, wherein step iii) comprises allowing the second part of the leading end of the web to fold away from the pick-up surface before step v).

18. The method according to claim 16, wherein step vi) comprises activating the supply unit to unwind the web from the media roll.

19. The method according to claim 14, wherein the holding mechanism comprises an attraction mechanism with a plurality of suction holes distributed over the pick-up surface and the holding step of step iii) comprises providing a suction pressure through the plurality of suction holes to a contact side of the web.

20. The method according to claim 14, wherein step v) comprises sliding over an outer side of the web along the pick-up surface starting from the first part of the leading end of the web to unfold the second part of the leading end of the web onto the pick-up surface.

* * * * *